US006595904B1

(12) United States Patent
Staffa

(10) Patent No.: US 6,595,904 B1
(45) Date of Patent: Jul. 22, 2003

(54) EXERCISE APPARATUS FOR STIMULATING MUSCLE COORDINATION, CONTRACTION AND JOINT STABILITY AND MOBILITY IN THE LOWER EXTREMITY JOINTS OF THE HIP, KNEE AND ANKLE WITH VARIABLE APPLICATION OF WEIGHT BEARING FORCE

(76) Inventor: Daniel Louis Staffa, 2702 Foxglove Ct., Pleasanton, CA (US) 94588

( * ) Notice: Subject to any disclaimer, the term of this patent is extended or adjusted under 35 U.S.C. 154(b) by 0 days.

(21) Appl. No.: 09/715,802

(22) Filed: Nov. 18, 2000

(51) Int. Cl.[7] ..... A63B 21/02

(52) U.S. Cl. ..... 482/123; 482/121; 482/122; 482/129; 482/135; 482/101

(58) Field of Search ..... 482/121, 123, 482/122, 129, 130, 124–128, 148, 135, 101

(56) References Cited

U.S. PATENT DOCUMENTS

| | | | | | |
|---|---|---|---|---|---|
| 4,434,981 | A | * | 3/1984 | Norton | 272/97 |
| 4,709,918 | A | * | 12/1987 | Grinblat | 272/97 |
| 5,279,530 | A | * | 1/1994 | Hess | 482/70 |
| 5,957,816 | A | * | 9/1999 | Staffa | 482/70 |
| 6,368,254 | B1 | * | 4/2002 | Wall | 482/71 |

* cited by examiner

*Primary Examiner*—Nicholas D. Lucchesi
*Assistant Examiner*—Lori Baker Amerson
(74) *Attorney, Agent, or Firm*—Reed Smith Crosby Heafey LLP

(57) ABSTRACT

An exercise apparatus providing resistance for hip and knee strengthening without increasing joint loading or shear force beyond that imparted by muscle contraction. A preferred embodiment includes a portable embodiment to allow continued use throughout changes in exercise environment.

12 Claims, 7 Drawing Sheets

EXERCISE APPARATUS FOR STIMULATING MUSCLE COORDINATION, CONTRACTION AND JOINT STABILITY AND MOBILITY IN THE LOWER EXTREMITY JOINTS OF THE HIP, KNEE AND ANKLE WITH VARIABLE APPLICATION OF WEIGHT BEARING FORCE

BACKGROUND OF THE INVENTION

1. Technical Field

This present invention relates generally to devices using dynamic therapeutic movement and strengthening for rehabilitation of the ankle, knee and hip with variability from non-weight bearing to full weight bearing force.

2. Description of the Related Art

The importance of therapeutic exercise is widely accepted for a variety of human disabilities. Exercise plays a crucial role in the rehabilitation of patients suffering from various injuries. Physical therapists regularly provide rehabilitative professional care that individually tailors exercise programs to meet a patient's needs. Rehabilitative exercise programs differ depending on the type and amount of damage to the injured area, stage of tissue healing, age of the person, and prior level of function of the individual prior to injury.

In many cases, lack of exercise is a contributing factor, if not the primary predisposing factor influencing injury in an adult. The human body was meant to move. As people get older they move less and sit more. Movement increases blood supply which facilitates greater nutrients to muscle and bone and maintains the health of the living tissue. In particular, the meniscus of the knee is considered an avascular structure and obtains most of its nutrients via the synovial fluid within the joint capsule. Movement of the knee is vital to the distribution of those nutrients. The lack of movement results in poor distribution of nutrients and tissues becomes weaker and more susceptible to injury.

The importance of early movement and strengthening to the recovery of hip, knee and ankle injuries is widely accepted. In particular, studies have shown that people who have undergone ACL reconstructive surgery and have started early movement have fared better than those of the past in which rest and fixation of the knee were thought to be the best approach. Physical therapists regularly provide rehabilitative professional care to individuals who are recovering from hip, knee and ankle injuries. A goal in all hip and knee injuries whether post surgical or non-surgical, is to get early pain free movement. A common limitation with rehabilitation of post surgical knee and hip patients is the restriction of weight bearing. Weight bearing restrictions may vary in time frames from one day post-operative to twelve weeks of limited weight bearing status. The amount of weight bearing and how early weight bearing can start depends on the surgery or trauma to the tissue. Weight bearing status may range from 'toe-touch' to 'partial weight bearing' 'to weight bearing as tolerated' and, finally, 'full weight bearing' with or without restriction for rotational movements.

The most common early rehabilitation methods consist of isometric exercise, Continuous Passive Motion (CPM) machines and or active assisted range of motion (ROM) performed by a therapist on a patient. Isometric exercise is a good way to initiate strength into newly repaired tissue but the benefits are limited to the point in the ROM that the exercise takes place and does not generally facilitate movement in post-operative rehabilitation. The return to normal or pre-surgical levels of movement has long been heralded one of the most important achievements in recovery and many people have proposed that the use of CPMs help achieve that goal the best. There is a CPM that has utilized movement facilitation through the femur instead of the foot, yet there is no definitive study that demonstrates either the traditional CPM or the newer model that avoids compressive forces is truly the most beneficial form of rehabilitation of hip and knees.

A third common means for obtaining strength and movement in post surgical or post traumatic injuries to the knee or hip is ROM performed by a physical therapist. The biggest restriction with this approach is that therapy is labor intensive, costly and infrequent. The techniques used by physical therapists to establish and/or maintain ROM is either passive ROM or active assisted ROM. Active assisted ROM is usually instituted after a certain time for healing to occur or pain has decreased with contraction of the muscles. The limited exercises given to patients at present for their home program consist usually, but not solely, of isometric muscle setting exercises to the gluteal and quadriceps muscles. These exercises do not involve joint movement. Exercises that are usually instituted later in the rehabilitation process utilize a resistive band and may provide less stability to the joint and are generally less comfortable, therefore, usually yield less patient compliance. Finally, patients are given a variation of exercises that involve open and closed chain activity. These can place an unwanted compressive or shear force on the joints.

CPM movement is completely passive and the patient does not physiologically control the movement. Although movement is occurring at the joint, muscle atrophy can persist and poor motor control may result.

Regular exercise may keep the body in good shape, but not all exercise is equally effective. In fact, many exercise devices on the market, particularly in health and athletic clubs, are less effective than people realize. That is not to say that the majority of the exercise equipment in health clubs is not beneficial under guidance by a trainer. Most available equipment in health clubs train in predominantly linear, single plane movement and is limited to isolating one muscle group while allowing other muscle groups to rest. Examples of this type of exercise can be put into two categories: the first is the leg press, a closed chain activity; the second exercise is the leg extension which is an open chain exercise and generally not considered ideal for knee or hip rehabilitation. This type of training may be appropriate in an athlete or one who has a balanced workout regimen, but isolated, open chain, planar movement is not how the body typically moves.

The body rarely moves in just one plane and often requires multiple muscle groups to work together. Most body movement involves rotation and diagonal patterns of movement. Imagine trying to without any arm swing or trunk rotation. Think of taking off a sweatshirt or pulling on a pair of socks with linear single planar movement—difficult? Yes! Taking a step requires combined movements of plantar flexion, internal hip rotation, foot pronation/supination, knee extension and hip extension. If we moved in single planes it would be easy to construct a mechanical hand, foot or leg to mirror human movement, but it is very difficult to replicate human movement because it is not defined through one or two dimensional movement. The myriad of muscles surrounding our joints allow us to move in limitless but controlled patterns.

Proprioceptive Neurofacilitation, PNF, is a school of thought within physical medicine that believes the best form of rehabilitation for musculoskeletal injuries occurs in diagonal patterns through multiple planes of movement. However, this treatment technique requires a purely hands-on, manual approach, extremely demanding of therapist skill and training. The therapist presently practicing PNF must take the patient through the motions and provide appropriate resistance for the patient's need and present physical limitations. There is a need in the exercise equipment art, therapeutic or not, for an apparatus that provides structured, multiaxial, multi-pattern movement to the average healthy person or to someone recovering from hip, knee or ankle injury that would allow the patient to control for different muscle patterns.

While the prior art provides attempts at developing equipment that embodies movement components of rotational and diagonal non-liner exercise, in many cases, these are smaller replicas of machines found in many fitness centers. In fact, to my knowledge, there are few portable lower extremity machines that have attempted to provide a source of rehabilitation for those patients who have limited mobility and may only be able to exercise from a bed or chair. The Mini gym, is a portable apparatus that simulates the closed chain activity of a leg press. The device provides no support for the hip or knee and the only form of resistance is provided through the feet. There is no way to control for ankle inversion, eversion plantar or dorsiflexion. It is primarily a linear form of resistance that applies its force and load along the long axis of the bones, thus, any increase in resistance is going to approximation the joint and increase weight bearing forces. There is another piece of exercise equipment that has recently hit the exercise market and is targeting quick, portable exercise to shape the inner and outer thighs, abdominal and the gluteal muscles. The Beautiful U__ requires the person hold the apparatus as they exercise. This may be very limiting for patients with a strokes or less limber patients who are in a lot of pain after surgery. The location of force application is similar to the beautiful U__, but said apparatus does not require the user to hold it. Unlike the beautiful U__ with a rigid single dimension resistance, the present invention has a supple sling like rest that will contour to the user's leg and allow for lateral and diagonal movements. The Beautiful U__ only provides resistance in one plane, the present invention can provide variable directions of resistance at once.

The present invention, provides its resistance force perpendicular to the long axis of the femur or tibia, thus, providing an apparatus that facilitates simultaneous hip and knee movement similar to closed kinetic chain exercise without the compressive forces of weight bearing. It is hypothesized that it will also reduce the shear force usually encountered during open chained exercise. This apparatus also allows for an additional force of joint distraction. Said apparatus can also stimulate dorsiflexion or plantar flexion simultaneously with hip and knee extension. No other prior art demonstrates resistance to hip extension simultaneous with dorsiflexion or plantar flexion. In this day of managed care in which treatment is limited it is most important to provide a portable exercise apparatus. This is particularly important in acute care settings where patients cannot get out of their bed. The portability is also valuable to the versatility of the device to be used in sitting, standing, kneeling or lying in a supine position during bed rest.

Another device, illustrated in U.S. Pat. No. 5,279,530, attempted to exercise the lower extremity in a supine position. The disadvantages of this machine include: only linear movement; no rotational component. Moreover, the most significant embodiment of this device involves exercise of only the lower extremities and only in a supine position.

It would therefore be of significant value in the art to provide a device enabling a user to obtain multidimensional exercise that provides multiple embodiments and would allow the user to progress toward full rehabilitation by isolating the difficulty and complexity of movement. Healthy, as well as, injured users could benefit from a device that trains the extremities and the trunk musculature in an unloaded position.

SUMMARY OF THE INVENTION

A first object of the present invention is therefore to provide an improved exercise device which obviates or mitigates at least one of the aforementioned disadvantages of available devices.

In its broadest scope, the present invention provides a device that encourages multiple axes of muscle control while controlling for compressive joint forces. It allows exercise to occur in a horizontal position in which there is no axial loading of the joints. A compressive component may be added by utilizing the foot/ankle means of resistance. This means of resistance may be used to facilitate joint compression or add a component of joint distraction. Said apparatus may also be used with the person in a standing position as a final progression ending with total weight bearing. This device allows for much earlier rehabilitation than most of the prior art has revealed.

A specific embodiment provides a resistance means to the lower extremity that does not involve compressive joint force beyond that of a muscle contraction. A second specific embodiment minimizes shearing forces on the knee during resisted knee extension. A third specific embodiment facilitates rotation about the femur, not just straight hip/knee extension, via femoral means of resistance. The rotational component is important because the stance phase requires hip internal rotation with hip extension. A fourth specific embodiment provides for active assisted ROM for knee, hip and ankle movement. A fifth specific embodiment provides a multitude of combined resistance patterns, including but limited to: hip and knee flexion and extension, hip internal/external rotation and ankle dorsiflexion, plantar flexion, eversion and inversion.

In a more particular embodiment the person's position is one defined as a "quadruped" position with one lower extremity utilizing one or both means of resistance in the aforementioned combination of patterns. A person may also utilize said device prone on their stomach with one lower extremity utilizing one or both means of resistance in the aforementioned combination of patterns.

DETAILED DESCRIPTION OF THE PREFERRED EMBODIMENTS

For the purpose of this discussion certain anatomical regions and specific terminology will be defined and used throughout the remainder of this document. From herein, the trunk will refer to the multitude of bones, muscles and joints including the vertebral column from the first Thoracic vertebrae through the Sacrum, the pelvis girdle (but not the hip joint) and all muscles attaching to said joints that have no insertion sites on the humerus, scapula or the femur. For clarity, the term "approximation" will represent the forces that lessen joint space and encourage cocontraction of the muscles surrounding the proximal peripheral joint, i.e., the shoulder and the hip. For this discussion "stabilization" will represent dynamic muscle equilibrium resulting in isometric contractions muscle contraction without joint movement). Closed Kinetic chain will represent resistance or relative fixation of the most distal body component with movement occurring at the more proximal joints and multiple muscle cocontraction stimulation. Open chain will represent greater movement of the distal component relative to its more proximal components with primarily only agonist muscle activity. Pseudo-closed chain is defined as simulating closed chain activity with cocontraction of agonist and antagonist muscle groups and distal extremity movement with weight bearing variations.

The figures illustrate the general embodiments of the present invention, the L.E. slide. The function of this invention is to facilitate the user to exercise through a field of movement with multiple plane variations, thereby promoting peripheral joint dissociation from the trunk, facilitating maximal muscle contractions without incurring concomitant weight bearing forces upon the joints, facilitating multiple patterns of movement and muscle contractions and sequences, involving approximation/distraction of said involved joints, and encourage early post-trauma/surgical muscle and joint integrity and provide a controlled, reproducible means of muscle contraction and joint movement.

Figure 3:
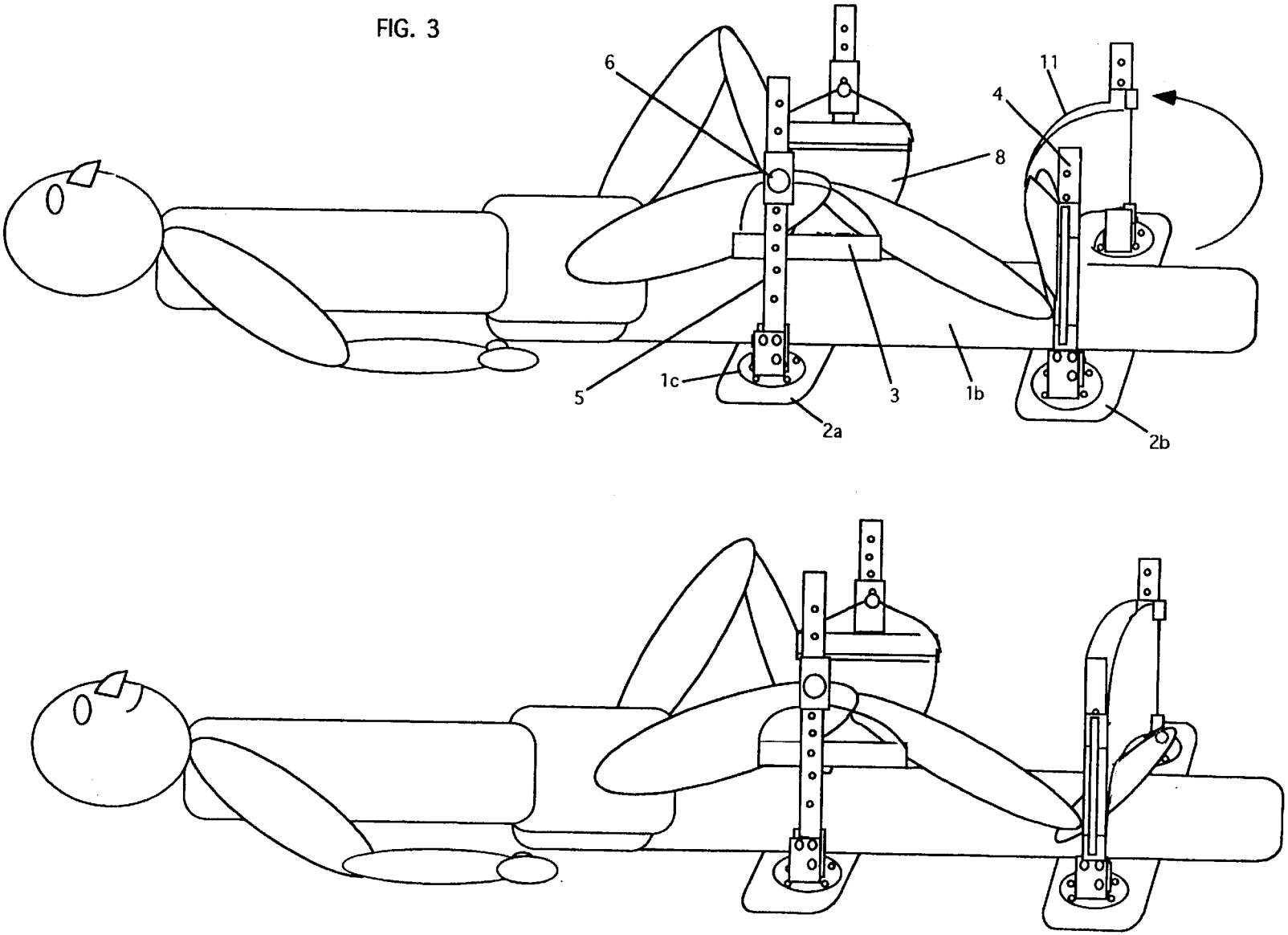
FIG. 3 illustrates a user demonstrating resisted dorsiflexion at the ankle using the foot means of resistance 11 while resisting the femur and tibia on the leg resistance means 8.

As illustrated in FIG. 3, this device will enable the user to simulate walking and squatting motions with adjustable variations in movement. Resistance means 8 is movably connected to base platform 1*b* via slide platform 2*a* which enables resistance means 8 to be located closer to the user's trunk or more distal down the leg closer to the user's feet. This variable of position of resistance means 8 within the length of the base platform 1*b* accommodates users of different heights and/or leg length differences to exercise on said apparatus. Resistance means 8 is movably connected about the vertical risers 4 to the slide couplers 6 via a moveable connection of cross bar 3 to slide coupler 6 by a small cable or a bolt/bushing connector that is not illustrated. The adjustability of the slide couplers 6 up and down risers 4 controls for the range of motion and further accommodate for variations in user size. If the slide couplers 6 are not level, a component of oblique resistance is added, this simulates relative abduction or adduction upon the lower extremity. Slide couplers 6 are held in place by pins/screws 6*b*.

Vertical risers 4 are movably connected to slide base platform 2*a* via channel couplings 1*c*. Adjustment pins/screws 6*b* allow for angle variations of risers 4 in relation to slide platform 2*a* which provides an additional manner of adjustment to the position of resistance means 8 upon the user's leg. Illustrations show three holes representing only two adjustment pin/screw 6*b* variations, but the scope of invention is not limited to a finite number of pin locations thus a limited number of angle positions. A groove connecting two of the pin holes 6*b* on channel coupler 1*c* would provide a greater freedom of angle movement of risers 4 upon slide base 2*a* and platform base 1*b*. Not illustrated, the adjustable connection of risers 4 to platform base 1*b* via slide base 2*a* and channel coupling 1*c* allow risers 4 to be lowered to a horizontal position in relation to platform base 1*b* to allow for easy portability and storage.

Figure 3A:
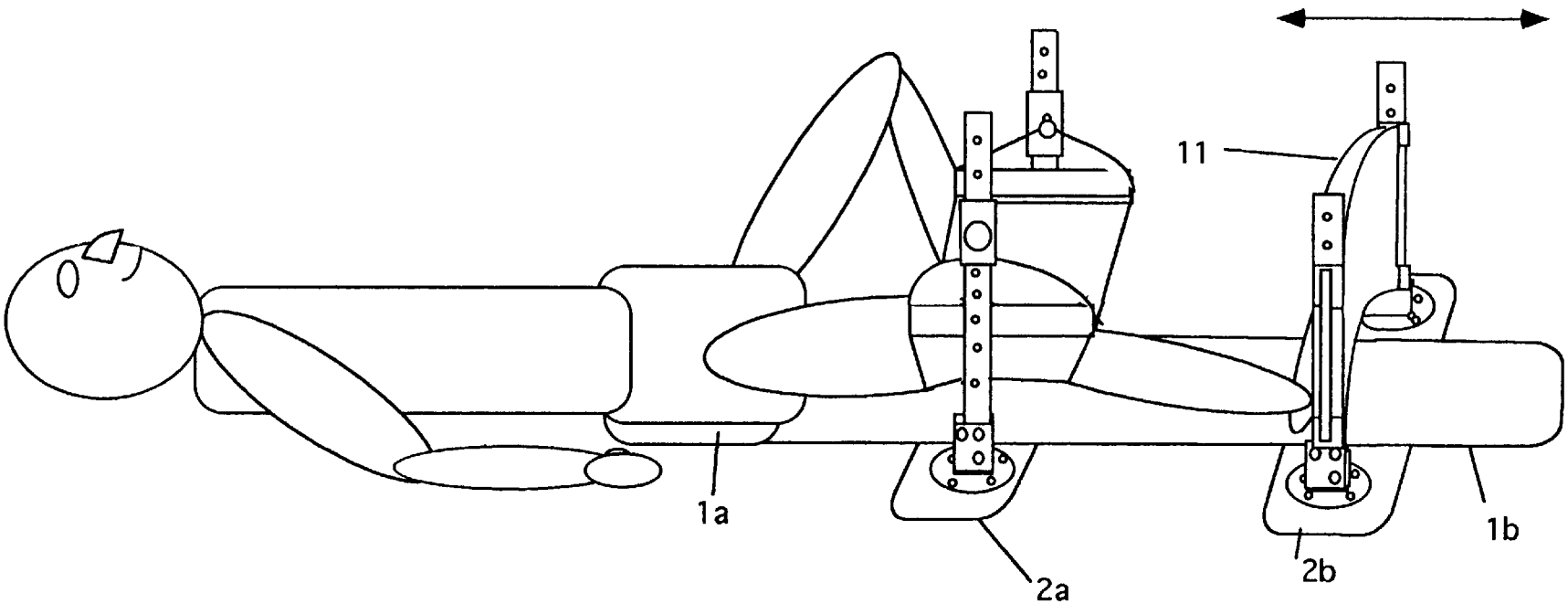
FIG. 3*a* illustrates a user demonstrating resisted hip/knee extension by use of the leg resistance means complex (8,8*a*,8*b*,8*c*,3,3*a*,7,5) with approximation of the lower extremity occurring through the foot contacting the foot resistance means 11.

Resistance to hip and knee extension via the leg resistance means complex (8,8*a*,8*b*,8*c*,3,3*a*,7,5) provide a resistance means that does not compress the joints as with traditional closed kinetic chain exercises. The user's thigh/knee/tibia encounters resistance forces parallel to the joint line, not perpendicular which is the case with closed kinetic chain activities such as walking, squatting, running and stair climbing. Shear and torsion forces that accompany open chain exercises such as knee extension machines in which the resistance contacts the anterior tibia are also mitigated by said invention. Said apparatus facilitates knee extension with resistance on the back of the femur and proximal to the knee thus helping to mitigate shearing and torsion forces. This is illustrated in FIG. 3, in which the user's thigh rests on top of resistance means 8. The resistance complex (8,8*a*,8*b*,8*c*,3,3*a*,7,5) has multiple components of multiplanar movements due to pliable/elastic nature of the means of resistance 8, flexible guide tubes 8*c*, pliable resistance pad 8*b* and the moveable connection of the resistance cross bar 3 to the slide couplers 6. The moveable connection of the resistance means complex (8,8*a*,8*b*,8*c*,3,3*a*,7,5) to the slide couplers allows resistance forces to remain in a constant direction relative to the user's leg throughout the entire range of motion; it also allows for the means of resistance 8, 8*b* to retain constant, equal and unchanging contact to the user's leg regardless of the position of the range of motion. As resistance mean 8 is lengthened when user presses his leg into the resistance means pad 8*b* (as illustrated in FIGS. 3, 3*a*) the pad 8*b* glides over the lengthening resistance means 8 via guide tubes 8*c* thus keeping the leg centered in the middle of resistance means 8. A further unique embodiment that sets the present invention apart from prior art is that resistance means 8*a* attaches to one cross bar and then to the resistance pad 8*b* and this imparts a rotational force about the long axis of the femur. Resistance towards inward rotation or outward rotation is imparted by increasing or unbalancing the outside and inside resistance means 8*a*. This may be done by shortening/lengthening and securing either the inside or outside resistance means 8*a* to its prospective cross bar 3 through resistance means 8*a* attachment to cross bar 3 via tension clips 7.

Resistance means 11 represents a band of elastic resistance which is wrapped around or held under tension bar 4*c* which in turn is fixed against slide coupler 4*b* via compression sleeves 4*d*. Slide coupler 4*b* slides up/down risers 4 and is held in position via pins/screw knobs 6*b*. FIG. 3, illustrates user's foot moving in to dorsiflexion against resistance means 11. This resistance adds force of distraction to the lower extremity which is not present in closed kinetic chain or open kinetic chain. Slide platform 2*b* is movably connected to base platform 1*b* via screw knob connectors that allow for easy position change of slide platform 2*b* upon base platform 1*b*. Moving slide platform 2*b* further away from user's foot can increase resistance to dorsiflexion and thus increase distraction force imparted to the lower extremity or slide platform 2*b* can be moved closer to user's trunk thus increasing resistance to plantar flexion, decreasing resistance to dorsiflexion and ultimately increasing weight bearing forces.

Although not illustrated, said device may also simulate pedaling. User would place the sole of one foot on resistance means 8, extend hip and knee and then bring heel into contact with base platform 1*b* and slide heel towards their buttocks simultaneously maintaining foot/heel contact with base platform 1*b*, raise foot off platform 1*b* at the desired amount of hip/knee flexion and repeat movement all the while maintaining foot contact with resistance means 8.

Figure 3B:
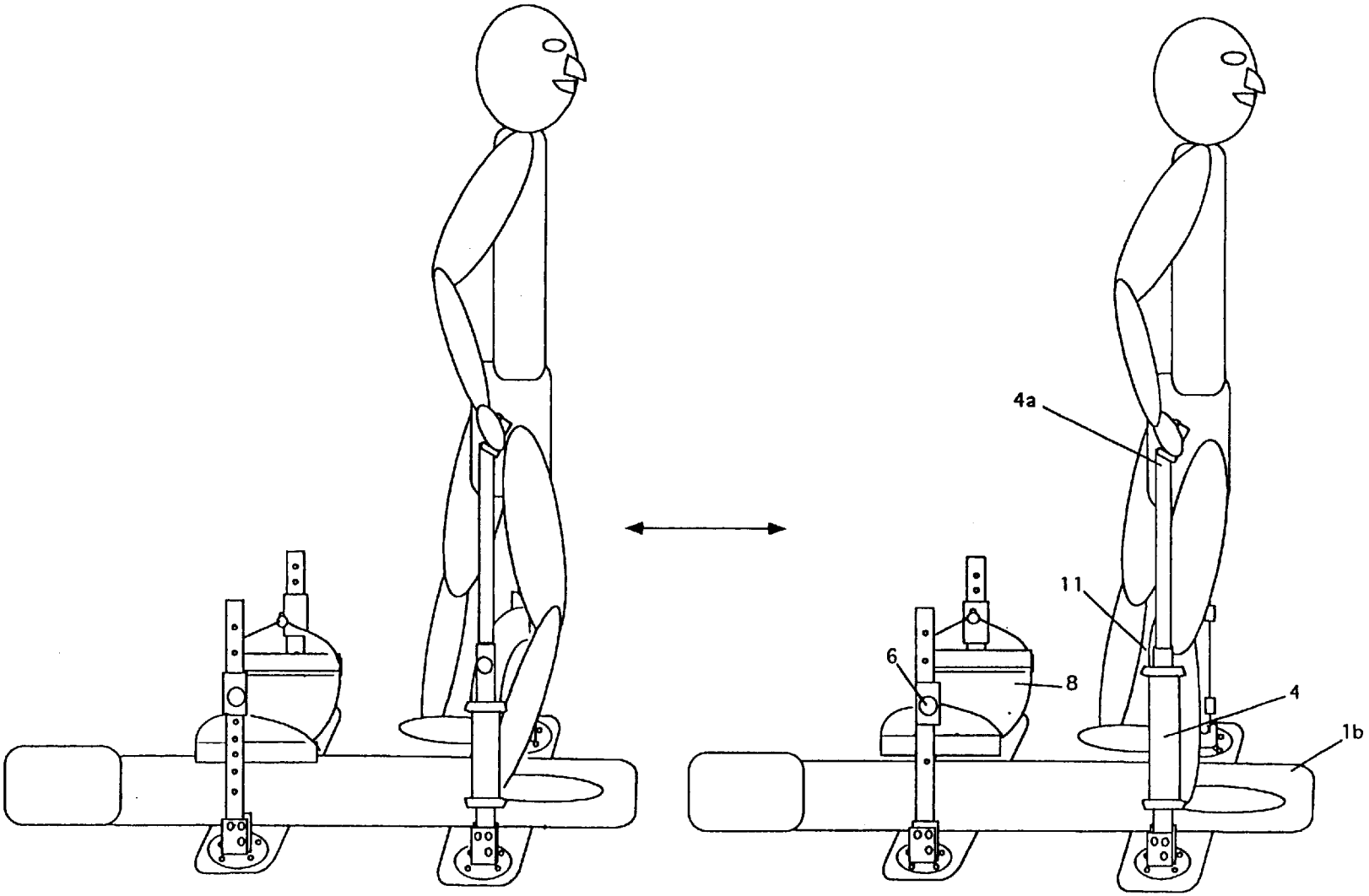
FIG. 3*b* Illustrates a user demonstrating weight shift onto the forward foot on the slide platform 1*b* with resisted hip/knee extension through the foot resistance means 11 while gripping the riser handle 4*a*.
Figure 3C:
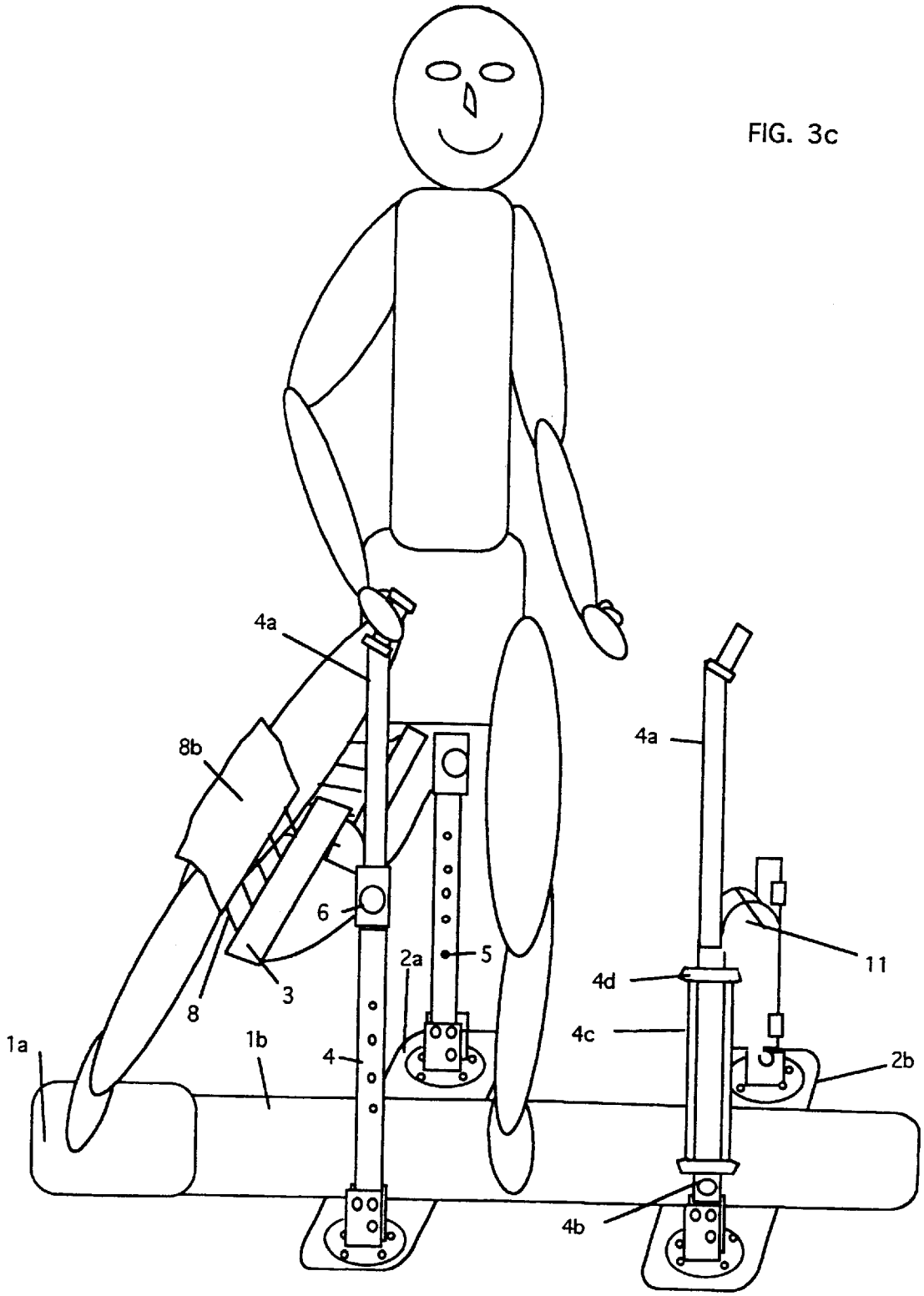
FIG. 3*c* Illustrates a user demonstrating resisted abduction with the leg resistance means complex (8,8*a*,8*b*,8*c*,3,3*a*,7,5) while grasping the riser handle 4*a* and standing on the slide platform 1*b*.
Figure 3D:
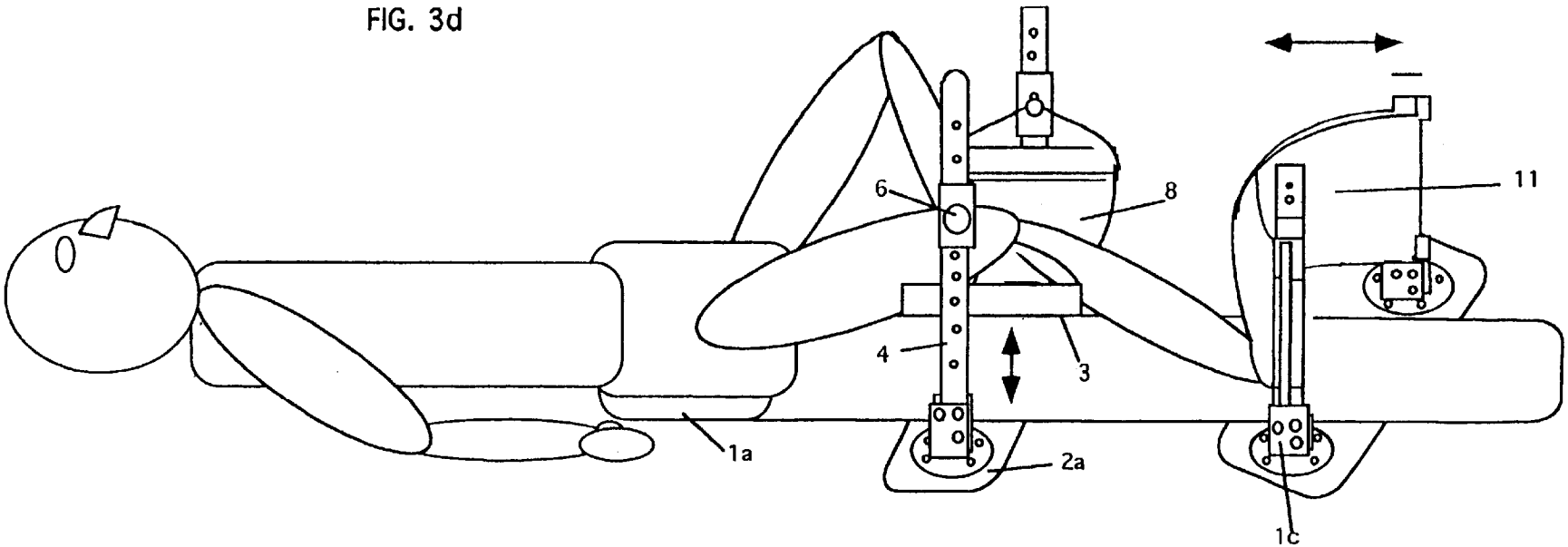
FIG. 3*d* Illustrates a user demonstrating resisted dorsiflexion and inversion.

As illustrated in FIG. 3*d*, said device allows for variation of resistance in the coronal plane of the lower extremity by changing the angle of the foot resistance means 11 in the perpendicular plane relative to the slide platform 1*b* through moveable attachments of the slide platform 2*b*, this variation allows either the outside or inside platform riser 4 to be positioned closer the user's trunk. This variability of the foot resistance means is defined by the physiologically movement patterns of inversion and eversion. FIG. 3*d* illustrates resistance to dorsiflexion with inversion. Eversion and inversion of the ankle have direct effect on the rotational forces through the entire lower extremity and are vital to the stability of the lower extremity during human locomotion. This device provides stimulation for these pattern as well others previously mentioned in a weight bearing or non weight bearing fashion. The ability of this device to provide resisted dorsiflexion and resisted plantar flexion in combination with inversion and eversion via the foot resistance means complex (11,4,4*b*,4*c*,4*d*,2*b*,1*c*) are not available in the prior art. These muscle contractions, along with internal and external rotation, are commonly used in the therapeutic technique of proprioceptive neurofacilitation (PNF) to enhance proximal joint and trunk stability. Weak and poor ability to cocontract and stabilize proximal lower extremity muscles and trunk muscles have been identified in orthopedic and physical therapy fields as a major precipitating factor in back injuries and can delay and inhibit proper neuromuscular patterns in the lower extremities FIG. 3*b*, illustrates a progression to full weight bearing position. Resisted hip and knee extension are resisted in FIG. 3*b* by the foot resistance means 11 while the user stabilizes himself by grasping the riser handle 4*a*. Not shown in the illustration, a user could place his knee behind the foot resistance means 11 and practice weight shifting forward into the foot resistance means 11 with focus on eccentric control of the knee extensor muscles. FIG. 3*b* illustrates a weight bearing concentric muscle contraction in which the quadriceps muscle is shortening as the posterior leg pushes into the resistance means 11.

The sling-like manner and elastic properties of the resistance means for both the foot and leg resistance (11,8,8*a*) facilitates multiple directions of resistance not found in the prior art. The amount of resistance to rotation, hip/knee extension, plantar flexion, dorsiflexion, inversion eversion and/or knee flexion can be obtained through tightening the resistance means: securing it with tension clips 7 or cleats 7*a* for the leg resistance means; securing it with tension bar 4*c* and bar cap 4*d* for the foot resistance; and, securing the hamstring resistance means 12 with the hamstring handle 13 as the resistance means 12 passes through eyelet guides 10 to the ankle bracelet 9 or having the user pull on the hamstring handle 13. This device can also be utilized with the user in a quadruped, standing supine, prone or side lying position with no fundamental changes in the embodied design.

Figure 1:
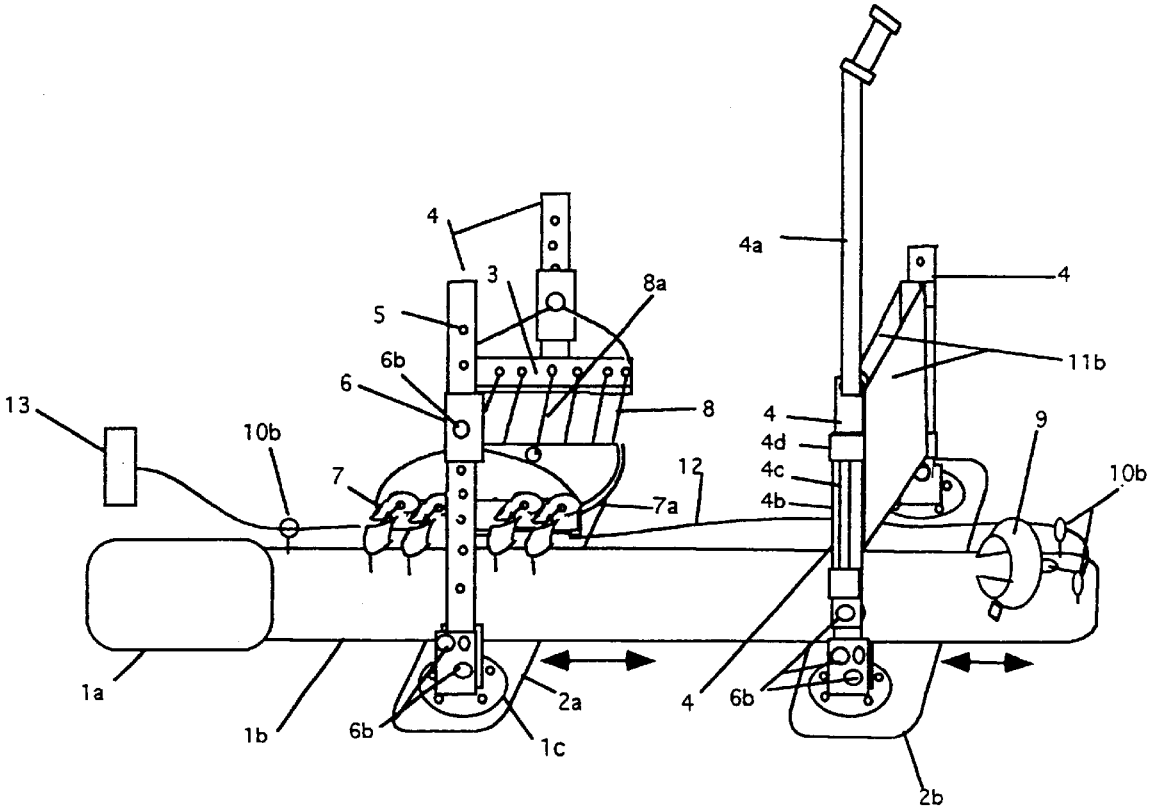
FIG. 1 is a perspective view of one of the embodiments of the L.E. Slide device in the horizontal plane.
Figure 2:
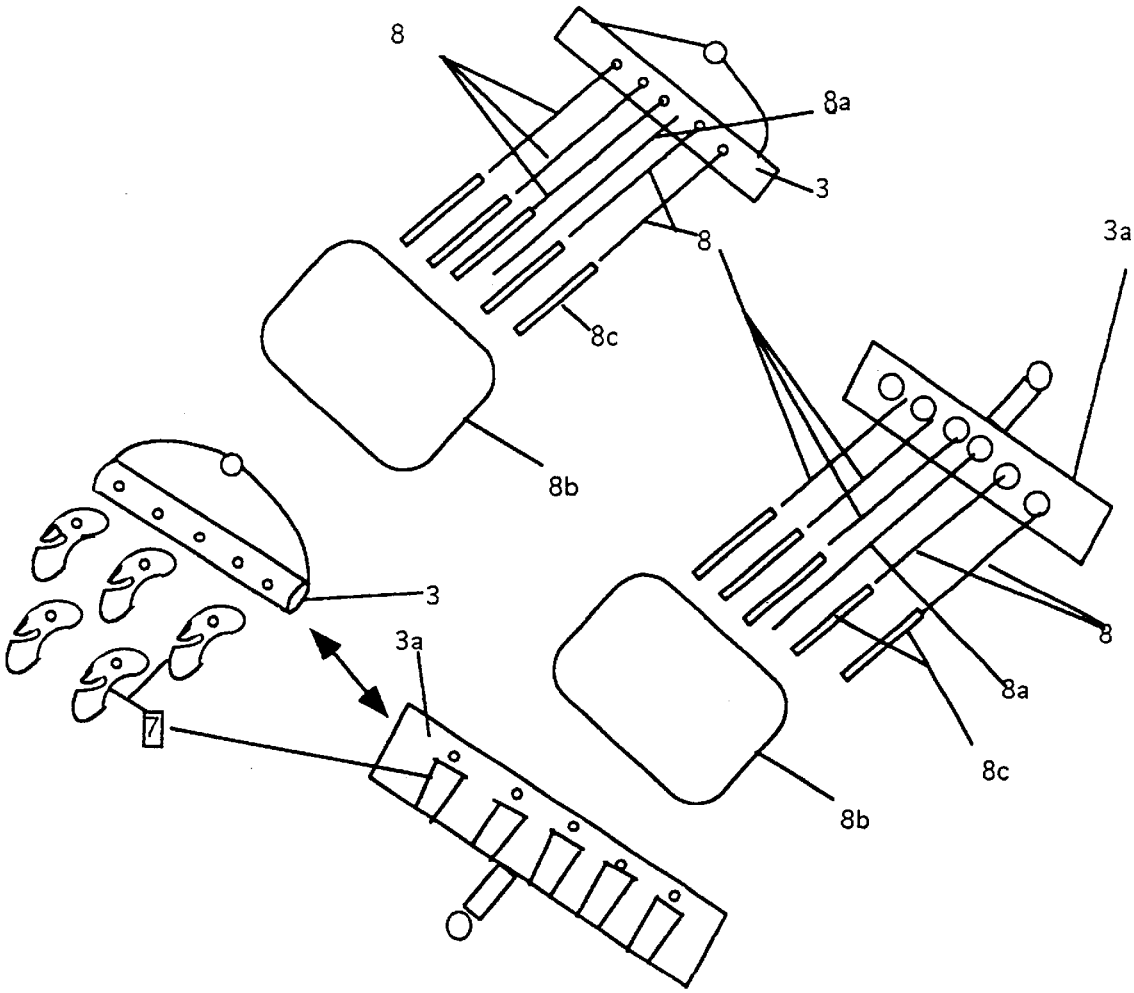
FIG. 2 is an exploded view of the femoral resistance means of said device in the horizontal plane.

The foundation of the unit is the slide platform and base platform represented in (FIG. 1) 1*b*, 2*a* and 2*b* with the gluteal pad la movably attached to the slide platform 1*b*. The movably attached gluteal pad 1*a* adds another method of adjustablity for different heights and leg lengths of users. The base platform 1*b* will be available in multiple widths and the slide platform 2*a*, 2*b* will come in fixed width models and adjustable width models. The foot slide platforms 2*b* will come in fixed and adjustable models to accommodate for the varying angles needed to facilitate inversion and eversion. Platform riser mounts 1*c* are adjustable for horizontal and vertical positions to allow the risers to parallel the slide platform for easy transport and storage. A riser handle 4*a* with a quick release feature allows for increased stability with the said device used in a standing position.

The functional advantage over the prior art is that said device simulates walking by allowing resistance to multiple joints in multiple planes without the limitations of traditional closed kinetic chain activity or open kinetic chain exercise which is predominantly a single plane movement. The ability to elicit multiple muscle patterns is augmented by the IR/ER resistance means 8*a* (see FIG. 1) which provides increasing or decreasing resistance to internal or external rotation with hip and knee extension. Independent raising and lower of slide couplers 6 up/down risers 4 produce abduction and adduction resistance forces. Independent movement of the foot complex (11,4,4*b*,4*c*,4*d*,2*b*,1*c*) risers 4 up and down the length of the base platform 1*b* imparts inversion and eversion force through the foot. Previously, all aforementioned combinations of movement have only been accessible through weight bearing activities or special rehabilitative techniques which are labor intensive and require a therapist's assistance. All embodiments of the present invention, except the bushing and bearings, could be manufactured using steel, aluminum alloys, graphite, or reinforced plastics. The variety of the different possibilities of materials would change only the cost and strength of the device and would not affect any of the major embodiments of movement, herein disclosed for this device.

It will be evident that there are numerous embodiments of the apparatus of this invention which are not described above but which are clearly within the scope and spirit of this device. Consequently, the above description is intended to be exemplary only.

What is claimed is:

1. An exercise and rehabilitation device to stimulate walking and squatting motions of a user, said device comprising a base platform and a sliding platform with a gluteal pad movably attached to the slide platform, resistance means movably connected to said base platform via said slide platform enabling said resistance means to be repositioned with respect to the user, said resistance means comprising parallel bands of elastic resistance providing the user with a sling having elastic properties which provides constant equal and unchanging contact to the user regardless of the user's position during the user's range of exercise motion.

2. The exercise and rehabilitation device of claim 1 further comprising at least one vertical member movably connected to said resistance means enabling said resistance means to navigate in a plurality of movement patterns.

3. The exercise and rehabilitation device of claim 2 wherein the angle between said vertical member and said base platform is variable.

4. The exercise and rehabilitation device of claim 2 wherein said device is portable.

5. The exercise and rehabilitation device of claim 1 where said device comprises two resistance means, a first resistance means for hip and knee exercise and a second resistance means for ankle exercise.

6. The exercise and rehabilitation device of claim 1 further being characterized as having slide couplers which can be independently raised and lowered to produce abduction and adduction resistive forces.

7. A method of exercising in a supine position on an exercise apparatus, the method comprising:

placing a leg into a resistance structure;

increasing tension on one side of the resistance structure;

pushing the leg into the resistance structure to produce hip extension, while emphasizing internal or external rotation of the leg;

placing a foot into a foot resistance structure to increase joint compression and to stimulate foot inversion, eversion, and plantar flexion; and positioning at least one riser on the apparatus away from or towards a user to control an amount of joint compression.

8. A method of exercising in a supine position on an exercise apparatus, the method comprising:

placing a leg into a resistance structure;

increasing tension on one side of the resistance structure;

pushing the leg into the resistance structure to produce hip extension, while emphasizing internal or external rotation of the leg;

placing a foot into a foot resistance structure to increase joint compression and to stimulate foot inversion, eversion, and plantar flexion; and wherein a user positions a first riser closer or further to the user's body than a second riser to create an angle between the foot resistance structure and the user's foot, and then places a leg into the first resistance apparatus, while pushing the foot into the foot resistance apparatus to simulate walking on an uneven surface.

9. A method of exercising in a supine position on an exercise apparatus, the method comprising:

placing a leg into a resistance structure;

increasing tension on one side of the resistance structure;

pushing the leg into the resistance structure to produce hip extension, while emphasizing internal or external rotation of the leg;

placing a foot into a foot resistance structure to increase joint compression and to stimulate foot inversion, eversion, and plantar flexion; and wherein a user places a foot under the foot resistance structure, such that the foot resistance structure is in contact with a top of the foot, thereby decreasing joint compression and stimulating foot inversion, eversion, and dorsi flexion.

10. The method of claim 9, wherein the user slides at least one riser away from or towards the user to control a distraction force.

11. A method of exercising in a standing position on an exercise apparatus, the method comprising:

positioning an anterior portion of a leg in contact with a resistance structure;

increasing tension on one side of the resistance structure;

performing a squat type motion to produce hip and knee extension, the resistance structure resisting internal or external rotation with joint approximation;

wherein the user positions the resistance structure in contact with gastroc-soleus muscles and then performs the squat type motion.

12. An exercise apparatus that provides for exercises in multiple planes of movement and multiple planes of resistance, the apparatus comprising:

a platform base;

a first resistance structure comprising:

a resistance pad; and a combination of variable elastic bands that have at least one end connected to the resistance pad;

an anchor connected to the first resistance structure;

a coupler connected the first resistance structure via the anchor;

a riser connected to the coupler such that a horizontal angle of resistance of the first resistance structure can be raised or lowered to impart a moment vector of adduction or abduction to a lower extremity during use;

a second resistance structure comprising:

a variable elastic resistance structure; and a foot coupler;

at least one riser connected between the second resistance structure and the platform base;

a movable buttocks pad connected to the platform base; and a belt to secure a user's pelvis to the movable buttocks pad during use.

* * * * *